US012569716B2

(12) United States Patent
Gao

(10) Patent No.: US 12,569,716 B2
(45) Date of Patent: Mar. 10, 2026

(54) MULTIFUNCTIONAL FITNESS FACILITY

(71) Applicant: Shenzhen Speediance Life Tech Limited, Shenzhen (CN)

(72) Inventor: Shifan Gao, Shenzhen (CN)

(73) Assignee: Shenzhen Speediance Life Tech Limited, Shenzhen (CN)

( * ) Notice: Subject to any disclaimer, the term of this patent is extended or adjusted under 35 U.S.C. 154(b) by 160 days.

(21) Appl. No.: 18/494,162

(22) Filed: Oct. 25, 2023

(65) Prior Publication Data

US 2024/0066348 A1 Feb. 29, 2024

Related U.S. Application Data

(63) Continuation of application No. PCT/CN2021/130500, filed on Nov. 15, 2021.

(30) Foreign Application Priority Data

Apr. 26, 2021 (CN) ..... 202110453552.8

(51) Int. Cl.
*A63B 21/00* (2006.01)
*A63B 21/005* (2006.01)

(52) U.S. Cl.
CPC ..... *A63B 21/156* (2013.01); *A63B 21/154* (2013.01); *A63B 21/0058* (2013.01); *A63B 2210/50* (2013.01)

(58) Field of Classification Search
CPC ..... A63B 21/0058–0059; A63B 21/15; A63B 21/151; A63B 21/154; A63B 21/156; A63B 2210/50; A63B 22/02; A63B 22/0235
See application file for complete search history.

(56) References Cited

U.S. PATENT DOCUMENTS 5,709,636 A * 1/1998 Vallone ..... A63B 21/154 482/904
7,833,139 B1 * 11/2010 Endelman ..... A63B 21/4045 482/123

(Continued)

FOREIGN PATENT DOCUMENTS

CN 101062445 A * 10/2007
CN 102943802 A * 2/2013

OTHER PUBLICATIONS

English translation of first office action for Chinese Patent Application CN 202110453552, dated Nov. 10, 2021, 7 pages, retrieved from Global Dossier on May 30, 2025 (Year: 2021).*

(Continued)

*Primary Examiner* — Loan B Jimenez
*Assistant Examiner* — Kathleen M Fisk
(74) *Attorney, Agent, or Firm* — Westbridge IP LLC

(57) ABSTRACT

A multifunctional fitness facility includes a pedal, a motor compartment and a pulley block which are connected. The motor compartment is provided therein with a motor, a training rope is wound on the motor, and an end of the training rope passes out of the pulley block. A vertical support assembly fixedly connected to the motor compartment is further included. The vertical support assembly is provided with a display screen, the vertical support assembly and the pedal are respectively provided with a pulley mounting structure, and the pulley block is detachably mounted in the bracket assembly or the pulley mounting structure on the pedal. The multifunctional fitness facility is additionally provided with a vertical support assembly, and a pulley block can be mounted onto the vertical support assembly or a pedal according to the requirements of training actions, so as to realize standing training or sitting or lying training.

10 Claims, 7 Drawing Sheets

(56) References Cited

U.S. PATENT DOCUMENTS

| | | | | |
|---|---|---|---|---|
| 8,439,810 | B2 * | 5/2013 | Baudhuin | A63B 22/0007 482/92 |
| 8,827,877 | B2 * | 9/2014 | Giannelli | A63B 23/03575 482/99 |
| 11,998,795 | B2 * | 6/2024 | Zhu | A63B 22/0002 |
| 12,090,359 | B1 * | 9/2024 | Gonzalez | A63B 21/0058 |

OTHER PUBLICATIONS

English translation of international preliminary report on patentability for International Patent Application PCT/CN2021/130500, dated Oct. 31, 2022, 6 pages, retrieved from Global Dossier on May 30, 2025 (Year: 2022).*

* cited by examiner

MULTIFUNCTIONAL FITNESS FACILITY

CROSS-REFERENCE TO RELATED APPLICATIONS

The present application is a continuation of International Application No. PCT/CN2021/130500, filed on Nov. 15, 2021, which claims priority to Chinese Patent Application No. 202110453552.8, filed on Apr. 26, 2021. All of the aforementioned applications are incorporated herein by reference in their entireties.

TECHNICAL FIELD

The present invention relates to the technical field of fitness facilities, and more particularly to a multifunctional fitness facility.

BACKGROUND

With the improvement of living standards, more and more people begin to pay attention to their own physical management. Therefore, there are a variety of fitness facilities on the market, among which, strength training facility is a common type of fitness facility.

The existing strength training facility generally includes two types, one is a gantry type facility, which is used by users standing; and another is a sitting and horizontal facility, where the user is sitting or lying. When a user wants to do different training actions, e.g. changing from standing to lying, it is often necessary to use two different kinds of facilities. Firstly, purchasing two types of facilities undoubtedly requires a high purchase cost, and secondly, the placement of the two types of facilities requires a large space for placement.

SUMMARY

The technical problem to be solved by the present invention is to provide a multifunctional fitness facility with strong universality.

In order to solve the above technical problems, the technical solutions adopted by the present invention are as follows: a multifunctional fitness facility comprises a pedal, a motor compartment and a pulley block which are connected. The motor compartment is provided therein with a motor, a training rope is wound on the motor, and an end of the training rope passes out of the pulley block. A vertical support assembly fixedly connected to the motor compartment is further included. The vertical support assembly is provided with a display screen, the vertical support assembly and the pedal are respectively provided with a pulley mounting structure, and the pulley block is detachably mounted in the bracket assembly or the pulley mounting structure on the pedal.

The advantageous effects of the present invention are that the multifunctional fitness facility is additionally provided with a vertical support assembly, and a user can mount a pulley block onto the vertical support assembly or a pedal on his own according to the requirements of training actions, so as to realize standing training or sitting or lying training. This is highly versatile, greatly reducing the cost of facility acquisition and saving the space required for facility placement, so as to enhance the user's experience. Furthermore, the display screen provided on the vertical support assembly can display the training method and/or realize human-machine interaction, which can further bring convenience to users' use.

DETAILED DESCRIPTION OF THE EMBODIMENTS

Figure 1:
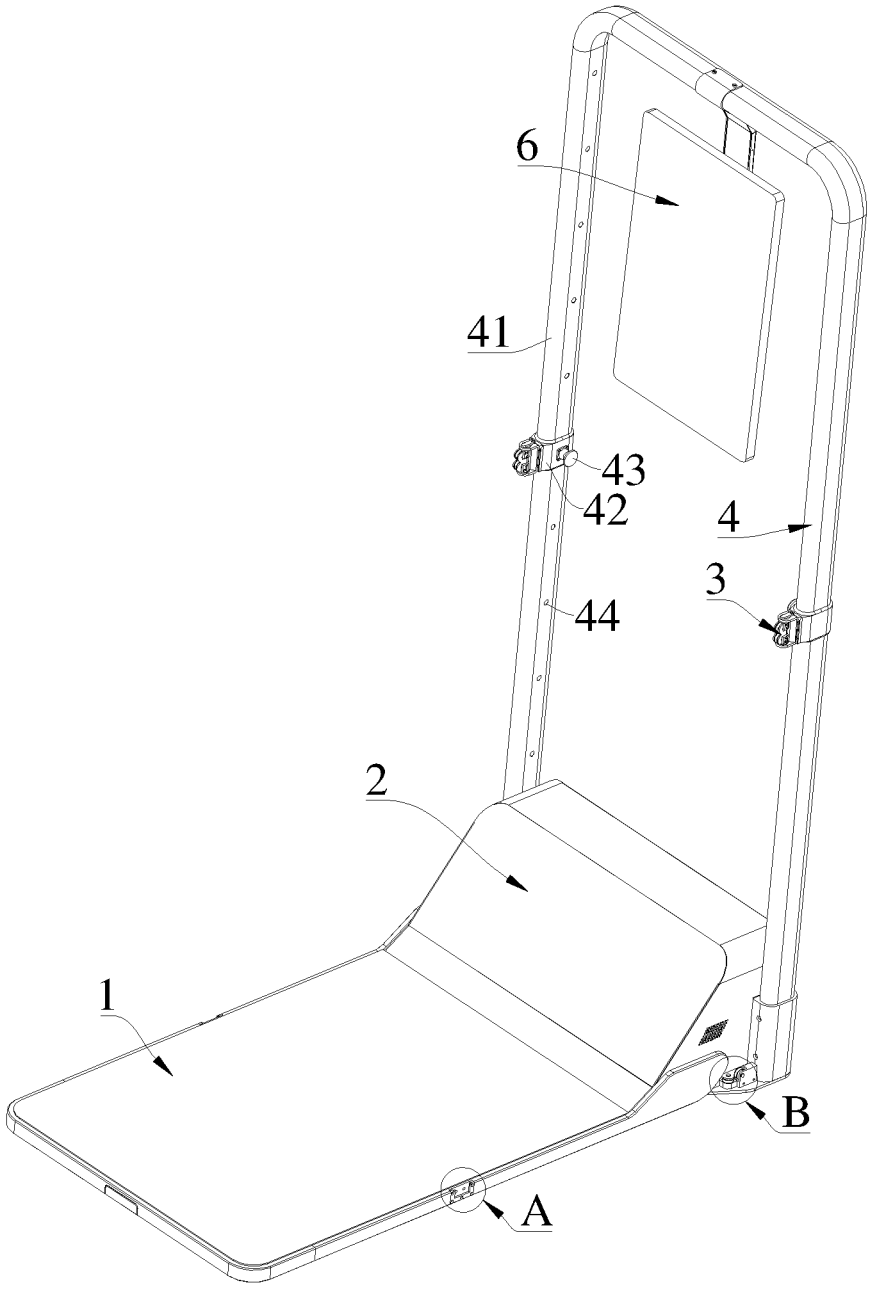
FIG. 1 is a schematic structural view of the overall structure of a multifunctional fitness facility of embodiment 1 of the present invention.

In order to explain the technical contents, the objects, and the effects of the present invention in detail, the following description will be given in conjunction with the implementation modes and in conjunction with the accompanying drawings.

With reference to FIGS. 1 to 11, a multifunctional fitness facility comprises a pedal 1, a motor compartment 2 and a pulley block 3 which are connected. The motor compartment 2 is provided therein with a motor, a training rope is wound on the motor, and an end of the training rope passes out of the pulley block 3. A vertical support assembly 4 fixedly connected to the motor compartment 2 is further included. The vertical support assembly 4 is provided with a display screen 6, the vertical support assembly 4 and the pedal 1 are respectively provided with a pulley mounting structure, and the pulley block 3 is detachably mounted in the bracket assembly or the pulley mounting structure on the pedal 1.

As apparent from the above description, the present invention has advantageous effects in that: the multifunctional fitness facility integrates the existing two commonly used strength training facilities, can be applicable to a variety of training actions, and has a very strong versatility; users do not need to purchase multiple training facilities, which reduces the cost of facility acquisition and saves the space required for facility placement, making it beneficial to enhance the user's experience and consumption experience; and furthermore, the display screen provided on the vertical support assembly can display the training method and/or realize human-machine interaction, which can further bring convenience to users' use.

Furthermore, the pulley block 3 comprises a fixed frame 31, a rotating frame 32 and two universal wheels 33. Two ends of the rotating frame 32 are respectively rotatably connected to the fixed frame 31, the universal wheels 33 are rotatably arranged on the rotating frame 32, the end of the training rope passes out from between the two universal wheels 33, and the fixed frame 31 is provided with a locking mechanism cooperating with the pulley mounting structure.

It can be seen from the above description that the pulley block 3 has a simple structure, is easy to manufacture and is cheap to produce. The universal wheel 33 can be automatically adjusted in multiple directions according to the user's actions by means of the rotating frame 32, which effectively improves the working stability of the pulley block 3.

Furthermore, the locking mechanism comprises an elastic member 341, a clamping plate 342, a sliding locking block 343 and a rotary clamping pin 344. The clamping plate 342 is connected to one side of the fixed frame 31 away from the universal wheel 33 so as to form an accommodating groove 311 accommodating a partial area of the rotary clamping pin 344, the rotary clamping pin 344 is rotatably arranged with respect to the fixed frame 31, one end of the rotary clamping pin 344 is exposed out of the fixed frame 31, and the sliding locking block 343 is slidably arranged between the clamping plate 342 and the rotary clamping pin 344. One end of the elastic member 341 is connected to a sliding locking block 343, the other end of the elastic member 341 is connected to the clamping plate 342 or the fixed frame 31, the sliding locking block 343 is provided with a locking head 3431, the clamping plate 342 is provided with a through hole 3421 for exposing the locking head 3431, and the rotary clamping pin 344 is provided with a protruding portion 3441 for driving the sliding of the sliding locking block 343. The pulley mounting structure comprises a socket 51 cooperating with the locking head 3431 and a limiting member 52 limitingly fixing the clamping plate 342.

It can be seen from the above-mentioned description that the locking mechanism can be stably locked with the pulley mounting structure, and the locking mechanism and the pulley mounting structure can also be quickly assembled and disassembled, which greatly facilitates the operation of a user and facilitates the use experience of a user.

Further, the rotary clamping pin 344 includes a rod portion 3442 and an operating portion 3443. The operating portion 3443 is exposed on the fixed frame 31 and connected to one end of the rod portion 3442, and the protruding portion 3441 is provided on the rod portion 3442.

It can be seen from the above-mentioned description that a user can control the unlocking/locking of the pulley block 3 via the operating portion 3443. The operation is extremely simple and advantageous for enhancing the user's use experience.

Further, at least one end of the rotating frame 32 is a hollow structure 321, one end of the rotating frame 32 is provided with an entrance communicating with the hollow structure 321, the rotating frame 32 is further provided with an exit communicating with the hollow structure 321, and the rope head of the training rope passes through the entrance, the hollow structure 321 and the exit in sequence to pass out from between the two universal wheels 33.

It can be seen from the above description that the end of the training rope is led out through the rotating frame 32, facilitating the reduction of the overall volume of the pulley block 3. Therefore, the pulley block 3 becomes small, thereby facilitating the disassembly and assembly by the user.

Further, the vertical support assembly 4 comprises a vertical rod 41 and a sliding sleeve 42 which is liftable and provided on the vertical rod 41, and the sliding sleeve 42 is provided with the pulley mounting structure.

It can be seen from the above-mentioned description that the pulley mounting structure in the vertical support assembly 4 can achieve height adjustment via the sliding sleeve 42, and the user can adjust the sliding sleeve 42 carrying the pulley block 3 to a suitable height according to the training action and the user's body, which is beneficial to further enhance the versatility of the multifunctional fitness facility.

Further, the sliding sleeve 42 is provided with an elastic latch 43, and the vertical rod 41 is provided with a plurality of insertion holes 44 arranged at intervals, and the insertion holes 44 cooperate with the elastic latch 43.

It can be seen from the above-mentioned description that the locking manner of the sliding sleeve 42 and the vertical rod 41 is simple and reliable, which further facilitates the user's operation.

Further, the pedal 1 is rotatably connected to the motor compartment 2, and a locking apparatus 7 is provided at a gap between the pedal 1 and the motor compartment 2.

It can be seen from the above-mentioned description that the rotary connection between the pedal 1 and the motor compartment 2 can facilitate the accommodation work of the multifunctional fitness facility and reduce the accommodation space occupied by the multifunctional fitness facility; and the locking apparatus 7 is provided to prevent accidental rotation of the pedal 1 relative to the motor compartment 2 so as to prevent accidents.

Furthermore, the locking apparatus 7 comprises a lock body and a lock seat 75 having a lock hole. The lock seat 75 is provided on the motor compartment 2. The lock body comprises a lock tongue 71, a reset member 72 and a guide rod 73. The guide rod 73 is slidably provided on the pedal 1, the reset member 72 is provided on the pedal 1 for driving the lock tongue 71 to be inserted into the lock hole, and the guide rod 73 is connected to the lock tongue 71.

As can be seen from the above description, the locking apparatus 7 has a simple structure and is inexpensive to manufacture.

Further, the bottom of the lock tongue 71 is provided with a guide surface 711, the top of the lock tongue 71 is provided with a first locking bevel 712, and the locking hole is provided therein with a second locking bevel 751 cooperating with the first locking bevel 712.

It can be seen from the above description that the provision of the guide surface 711 can ensure that the pedal 1 can be smoothly deployed; and the cooperation of the first locking bevel 712 with the second locking bevel 751 can reduce the machining accuracy requirements of the locking apparatus 7 and facilitate the reduction of the manufacturing cost of the locking apparatus 7. The cooperation of the first locking bevel 712 with the second locking bevel 751 can also ensure that the locking apparatus 7 always maintains an absolute locking state, thereby improving the structural stability of the multifunctional fitness facility.

Embodiment 1

With reference to FIGS. 1 to 11, embodiment 1 of the present invention is: a multifunctional fitness facility that allows a user to perform sitting or horizontal, and standing strength training.

As shown in FIG. 1, the multifunctional fitness facility comprises a pedal 1, a motor compartment 2, and a pulley block 3 which are connected and a vertical support assembly 4 fixedly connected to the motor compartment 2. The motor compartment 2 is provided with a motor, a training rope (not shown) is wound on the motor, the end of the training rope passes out of the pulley block 3 and is connected to a training accessory (not shown), the vertical support assembly 4 and the pedal 1 are respectively provided with a pulley mounting structure, and the pulley block 3 is detachably mounted in the pulley mounting structure on the support assembly or the pedal 1.

Specifically, the training accessories include, but are not limited to, an intelligent handle, a barbell bar, a double-headed rope, a leg buckle, etc. In order to facilitate quick disassembly and assembly of the training accessories and the training rope, a quick disassembly structure is provided at the connection of the training rope and the training accessories, such as a quick disassembly connector, etc.

Figure 2:
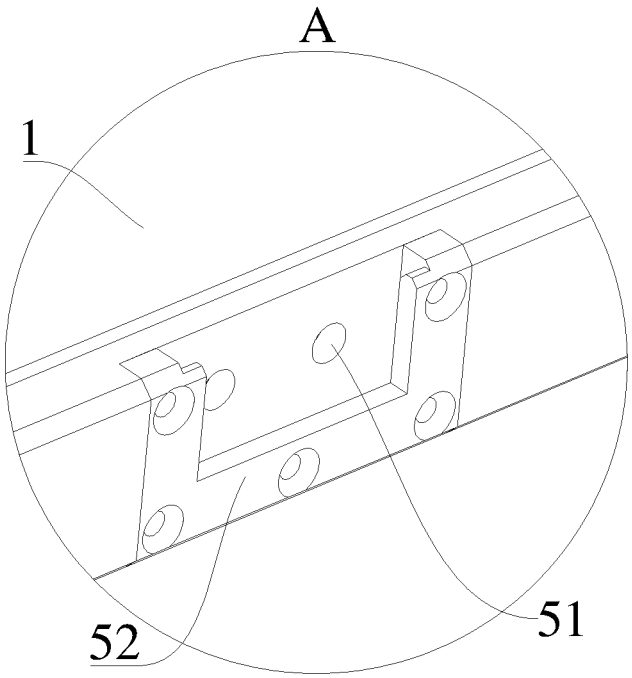
FIG. 2 is an enlarged view of detail A in FIG. 1.
Figure 4:
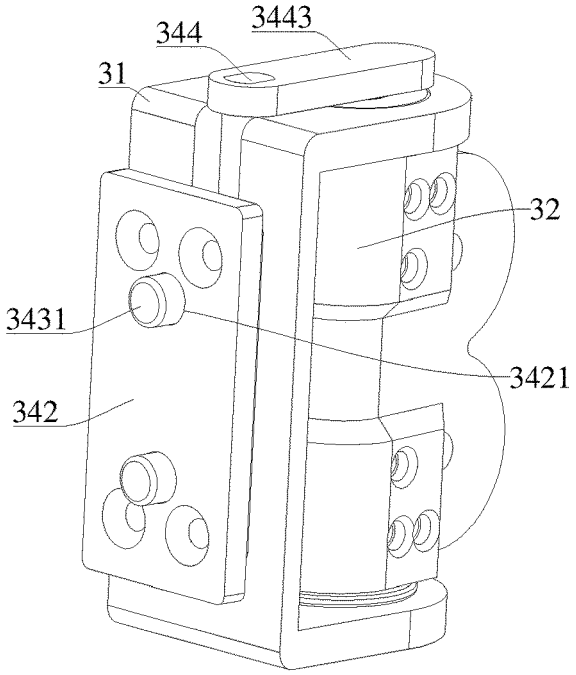
FIG. 4 is a schematic structural view of a pulley block in the multifunctional fitness facility of embodiment 1 of the present invention.
Figure 5:
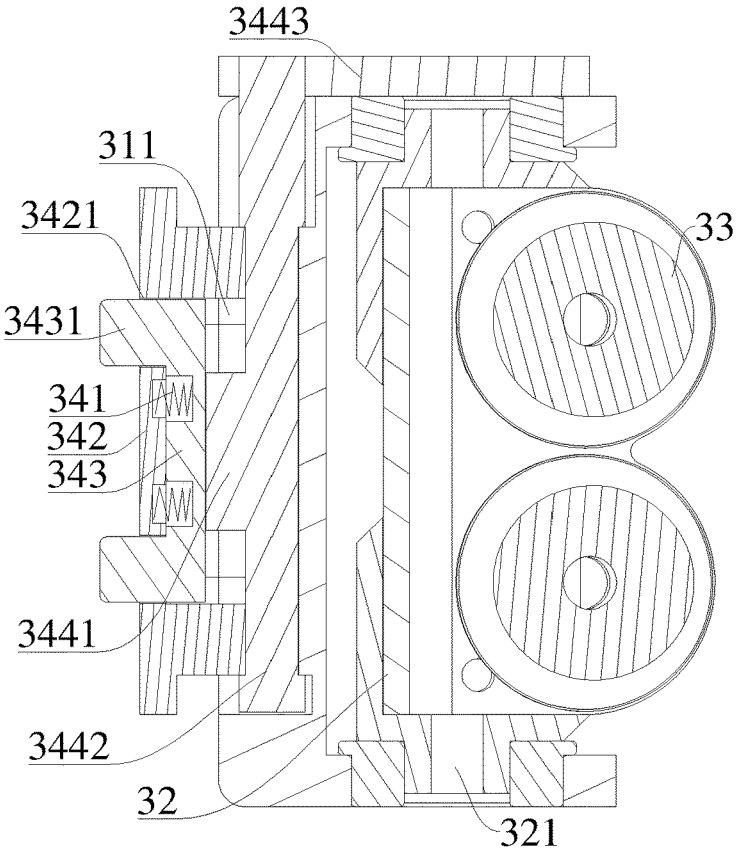
FIG. 5 is a sectional view of a pulley block in the multifunctional fitness facility of embodiment 1 of the present invention.
Figure 6:
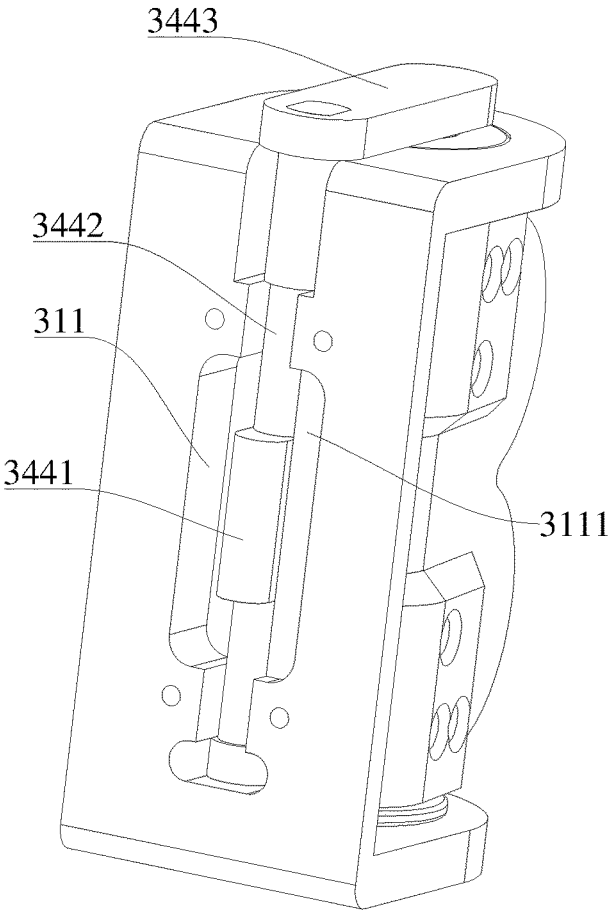
FIG. 6 is a schematic view of a partial structure of a pulley block in the multifunctional fitness facility of embodiment 1 of the present invention.
Figure 7:
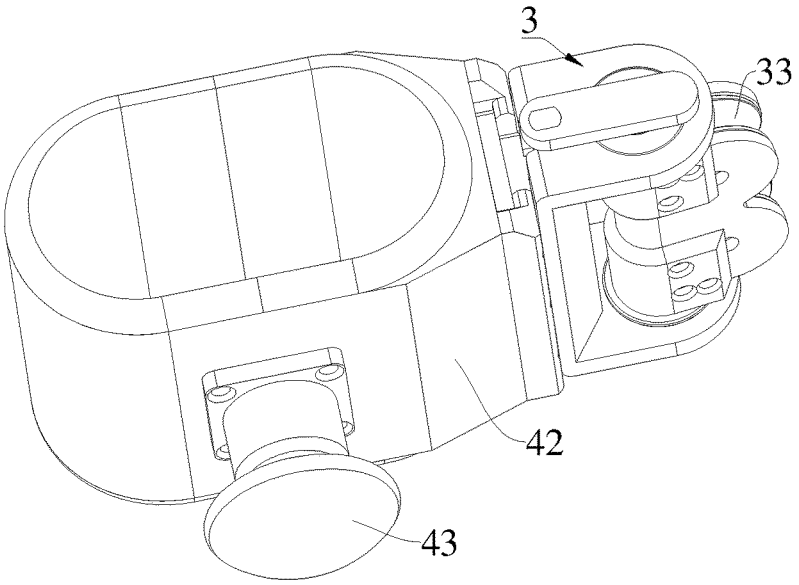
FIG. 7 is a schematic diagram of an assembly structure of the pulley block and a sliding sleeve in the multifunctional fitness facility of embodiment 1 of the present invention.

With reference to FIGS. 4 to 6, the pulley block 3 comprises a fixed frame 31, a rotating frame 32 and two universal wheels 33. Two ends of the rotating frame 32 are respectively rotatably connected to the fixed frame 31, the universal wheels 33 are rotatably arranged on the rotating frame 32, the end of the training rope passes out from between the two universal wheels 33, and the fixed frame 31 is provided with a locking mechanism cooperating with the pulley mounting structure. In the present embodiment, the locking mechanism comprises an elastic member 341, a clamping plate 342, a sliding locking block 343 and a rotary clamping pin 344. The clamping plate 342 is connected to one side of the fixed frame 31 away from the universal wheel 33 so as to form an accommodating groove 311 accommodating a partial area of the rotary clamping pin 344, the rotary clamping pin 344 is rotatably arranged with respect to the fixed frame 31, one end of the rotary clamping pin 344 is exposed out of the fixed frame 31, and the sliding locking block 343 is slidably arranged between the clamping plate 342 and the rotary clamping pin 344. One end of the elastic member 341 is connected to a sliding locking block 343, the other end of the elastic member 341 is connected to the clamping plate 342 or the fixed frame 31, the sliding locking block 343 is provided with a locking head 3431, the clamping plate 342 is provided with a through hole 3421 for exposing the locking head 3431, and the rotary clamping pin 344 is provided with a protruding portion 3441 for driving the sliding of the sliding locking block 343. With reference to FIGS. 2, 4, and 5, the pulley mounting structure comprises a socket 51 cooperating with the locking head 3431 and a limiting member 52 limitingly fixing the clamping plate 342.

When the pulley block 3 is mounted on the vertical support assembly 4, the arrangement direction of the two universal wheels 33 is in the vertical direction; and when the pulley block 3 is mounted on the pedal 1, the direction in which the two universal wheels 33 are arranged is in the direction of the pedal 1. That is, the pulley block 3 is mounted on the vertical support assembly 4 in a vertical manner or on the pedal 1 in a lateral manner.

With reference to FIGS. 4 to 6, when the rotary clamping pin 344 rotates, the protruding portion 3441 abuts and drives the sliding locking block 343, so that the locking head 3431 of the sliding locking block 343 passes out of the clamping plate 342 and is inserted into the socket 51 to complete the locking of the locking mechanism and the pulley mounting structure. When the rotary clamping pin 344 is rotated in the opposite direction, the sliding locking block 343 is drawn in by the elastic member 341, so that the locking head 3431 is retracted into the through hole 3421 of the clamping plate 342, completing the unlocking of the locking mechanism from the pulley mounting structure. In a preferred implementation mode, a limiting portion 3111 for limiting the rotation angle of the protruding portion 3441 is provided in the accommodating groove 311, and the presence of the limiting portion 3111 can prevent the excessive rotation of the rotary clamping pin 344 and reduce the user's operation efficiency, so as to reduce the probability of an accident.

Referring to FIGS. 2, 4, and 5, in the present embodiment, the transverse and longitudinal sections of the clamping plate 342 are respectively convex-shaped, respectively. The limiting member 52 has an overall concave shape and an L-shaped cross-section. Namely, a limiting groove for limiting the clamping plate 342 is formed between the limiting member 52 and the vertical support assembly 4/the pedal 1, the clamping plate 342 is limited by five degrees of freedom after being inserted through the opening of the limiting member 52, and only one degree of freedom that can withdraw from the opening of the limiting member 52 remains; and when the rotary clamping pin 344 in the locking mechanism drives the locking head 3431 to be inserted into the socket 51, the only one remaining degree of freedom of the clamping plate 342 is also limited, thereby completing the locking of the locking mechanism and the pulley mounting structure.

As shown in FIG. 6, the rotary clamping pin 344 includes a rod portion 3442 and an operating portion 3443. The operating portion 3443 is exposed on the fixed frame 31 and connected to one end of the rod portion 3442, and the protruding portion 3441 is provided on the rod portion 3442. In this embodiment, the operating portion 3443 has a rod shape, so that it can be easily operated by a user to rotate the rotary clamping pin 344.

As shown in FIG. 5, in order to reduce the overall volume of the pulley block 3, so that a user can move the pulley block 3 more conveniently, at least one end of the rotating frame 32 is a hollow structure 321, one end of the rotating frame 32 is provided with an entrance communicating with the hollow structure 321, the rotating frame 32 is further provided with an exit communicating with the hollow structure 321, and the rope head of the training rope passes through the entrance, the hollow structure 321 and the exit in sequence to pass out from between the two universal wheels 33. In detail, the rotating frame 32 includes a rotating shaft on which the entrance, the hollow structure 321 and the exit are respectively provided.

As shown in FIG. 1, the vertical support assembly 4 comprises a vertical rod 41 and a sliding sleeve 42 which is liftable and provided on the vertical rod 41, and the sliding sleeve 42 is provided with the pulley mounting structure. In the present embodiment, the number of vertical rods 41 is two, and two of the vertical rods 41 are connected via a cross bar. Optionally, the sliding sleeve 42 is provided with an elastic latch 43, the vertical rod 41 is provided with a plurality of insertion holes 44 arranged at intervals, a plurality of the insertion holes 44 are arranged along the length direction of the vertical rod 41, and the insertion holes 44 cooperate with the elastic latch 43. In other embodiments, the sliding sleeve 42 may be fixed in connection with the vertical rod 41 by other structures, such as an abutment screw or the like. In order to further enhance the versatility of the multifunctional fitness facility and the user's use experience, a display screen 6 is further provided on the vertical support assembly 4, so that a user can perform training according to the action essentials or other contents displayed on the display screen 6. Of course, the display screen 6 can be a touch-control display panel, and the touch-control display panel is electrically connected to the motor, and thus the user can adjust the parameters of the motor via the display screen 6 so as to achieve human-machine interaction. As will be readily appreciated, other means may be provided on the multifunctional fitness facility, such as music playing apparatus or the like. Users can operate these apparatuses through the display screen 6. In addition, in order to facilitate the storage and transportation of the multifunctional fitness facility, it is preferable that the vertical support assembly 4 is detachably connected to the motor compartment 2.

As shown in FIGS. 8-11, in order to further enhance the user's experience, the pedal 1 is rotatably connected to the motor compartment 2, a locking apparatus 7 is provided at the gap between the pedal 1 and the motor compartment 2, the locking apparatus 7 comprises a lock body and a lock seat 75 having a lock hole, and the lock seat 75 is provided on the motor compartment 2. The lock body is provided on the pedal 1. The lock body comprises a lock tongue 71, a reset member 72 and a guide rod 73. The guide rod 73 is slidably provided on the pedal 1, the reset member 72 is provided on the pedal 1 for driving the lock tongue 71 to be inserted into the lock hole, and the guide rod 73 is connected to the lock tongue 71. In the present embodiment, the number of the guide rods 73 is two, and two of the guide rods 73 are connected by a tailgate 74, and the user can unlock the locking apparatus 7 by moving the tailgate 74, which is extremely convenient to operate. It will be readily understood that it is also feasible that the lock body is provided on the motor compartment 2 and the lock seat 75 is provided on the pedal 1.

Figure 11:
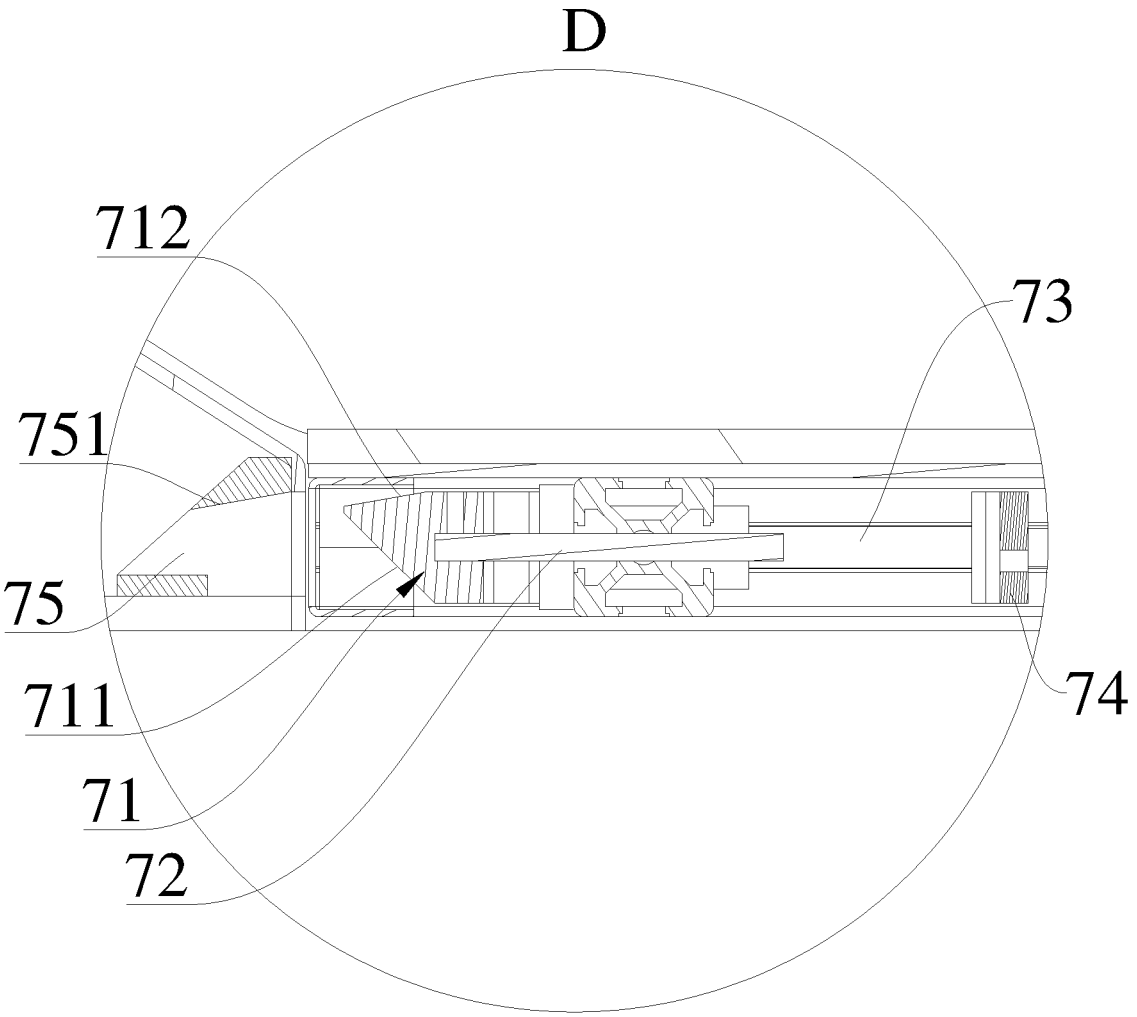
FIG. 11 is an enlarged view of detail Din FIG. 10.

As shown in FIG. 11, in order to reduce the machining accuracy requirements of the locking apparatus 7 and ensure the working stability of the locking apparatus 7, the bottom of the lock tongue 71 is provided with a guide surface 711, the top of the lock tongue 71 is provided with a first locking bevel 712, and the locking hole is provided therein with a second locking bevel 751 cooperating with the first locking bevel 712. In this embodiment, the guide surface 711 is a bevel and has a slope greater than the slope of the first locking bevel 712. In other embodiments, the guide surface 711 may also be a cambered surface or the like.

Figure 3:
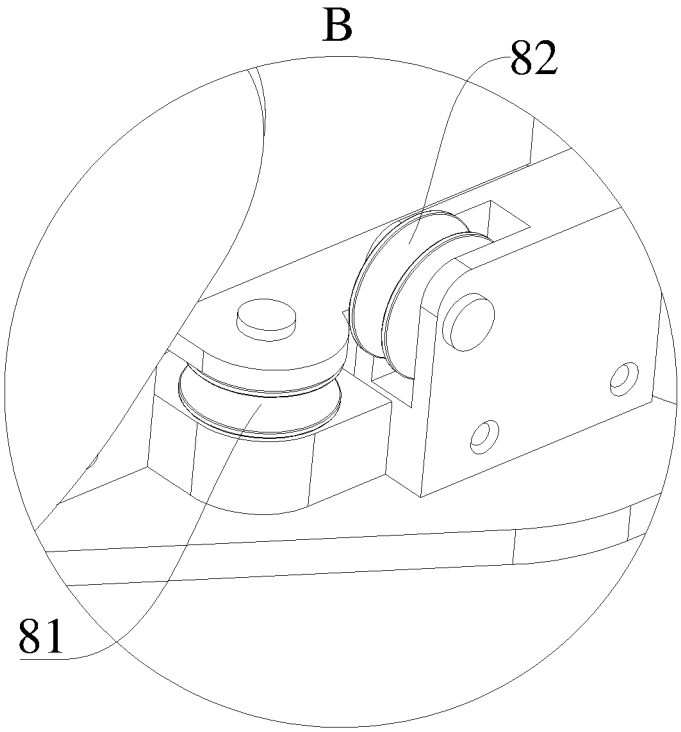
FIG. 3 is an enlarged view of detail B in FIG. 1.

Referring to FIGS. 1 and 3, as a preferred implementation mode, the motor compartment 2 is further provided with a steering wheel set comprising a first steering wheel 81 and a second steering wheel 82 adjacent to each other, the central axis of the first steering wheel 81 being perpendicular to the central axis of the second steering wheel 82. The central axis of the first steering wheel 81 is arranged perpendicular to the deployed pedal 1 and the central axis of the second steering wheel 82 is arranged parallel to the deployed pedal 1. In detail, the first steering wheel 81 and the second steering wheel 82 are respectively concave wheels, the first steering wheel 81 is located at the bottom of one side of the second steering wheel 82, and the training rope enters the second steering wheel 82 in a direction parallel to the direction of the deployed pedal 1 at the outlet position of the first steering wheel 81 and clings to the second steering wheel 82. More specifically, when the pulley block 3 is mounted on the pedal 1, the training rope winds around half a turn of the second steering wheel 82 and leads out and reaches the pulley block 3 in a direction parallel to the deployed pedal 1; and when the pulley block 3 is mounted on the vertical support assembly 4, the training rope winds around a quarter of a turn of the second steering wheel 82 and leads out and reaches the pulley block 3 in a direction parallel to the vertical rod 41. The steering wheel set provided in this way can ensure that the training rope can smoothly extend and retract relative to the motor compartment 2, which is beneficial to improve the working stability of the multifunctional fitness facility, prevent the training rope from jamming, and enhance the user's experience.

Figure 8:
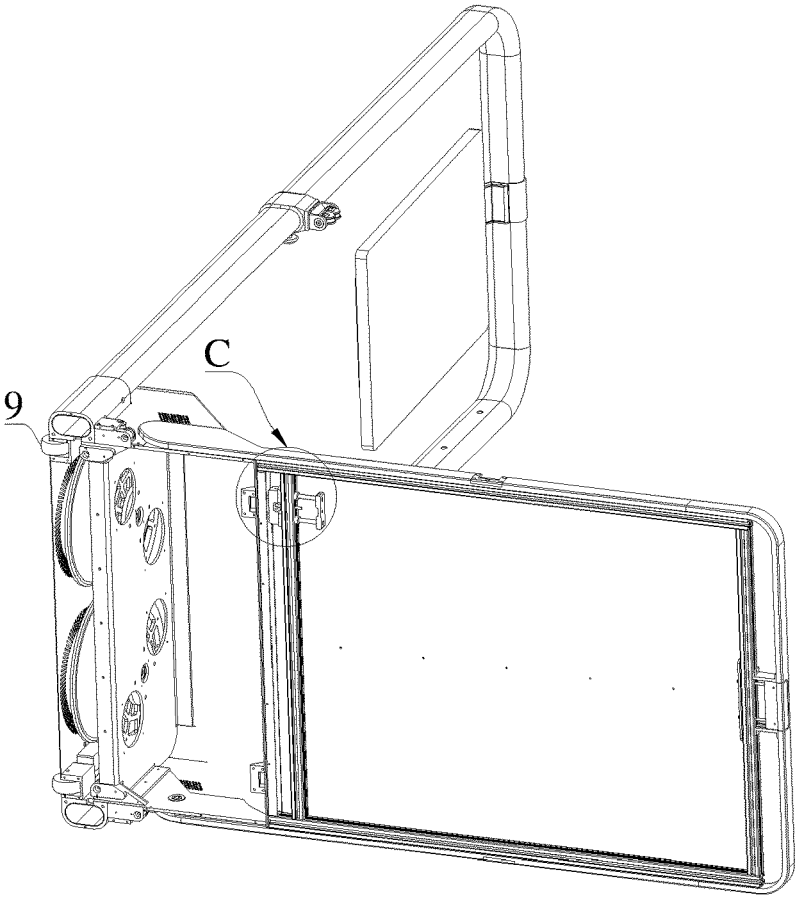
FIG. 8 is a schematic structural view of a partial structure of the multifunctional fitness facility of embodiment 1 of the present invention.
Figure 9:
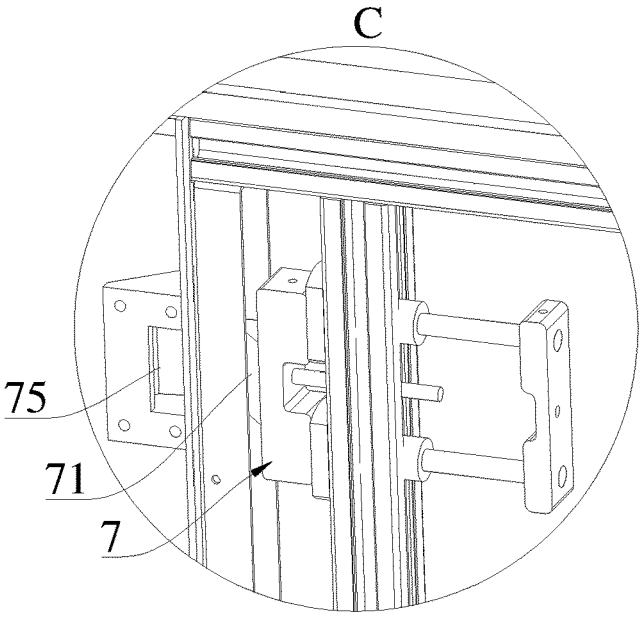
FIG. 9 is an enlarged view of detail C in FIG. 8.
Figure 10:
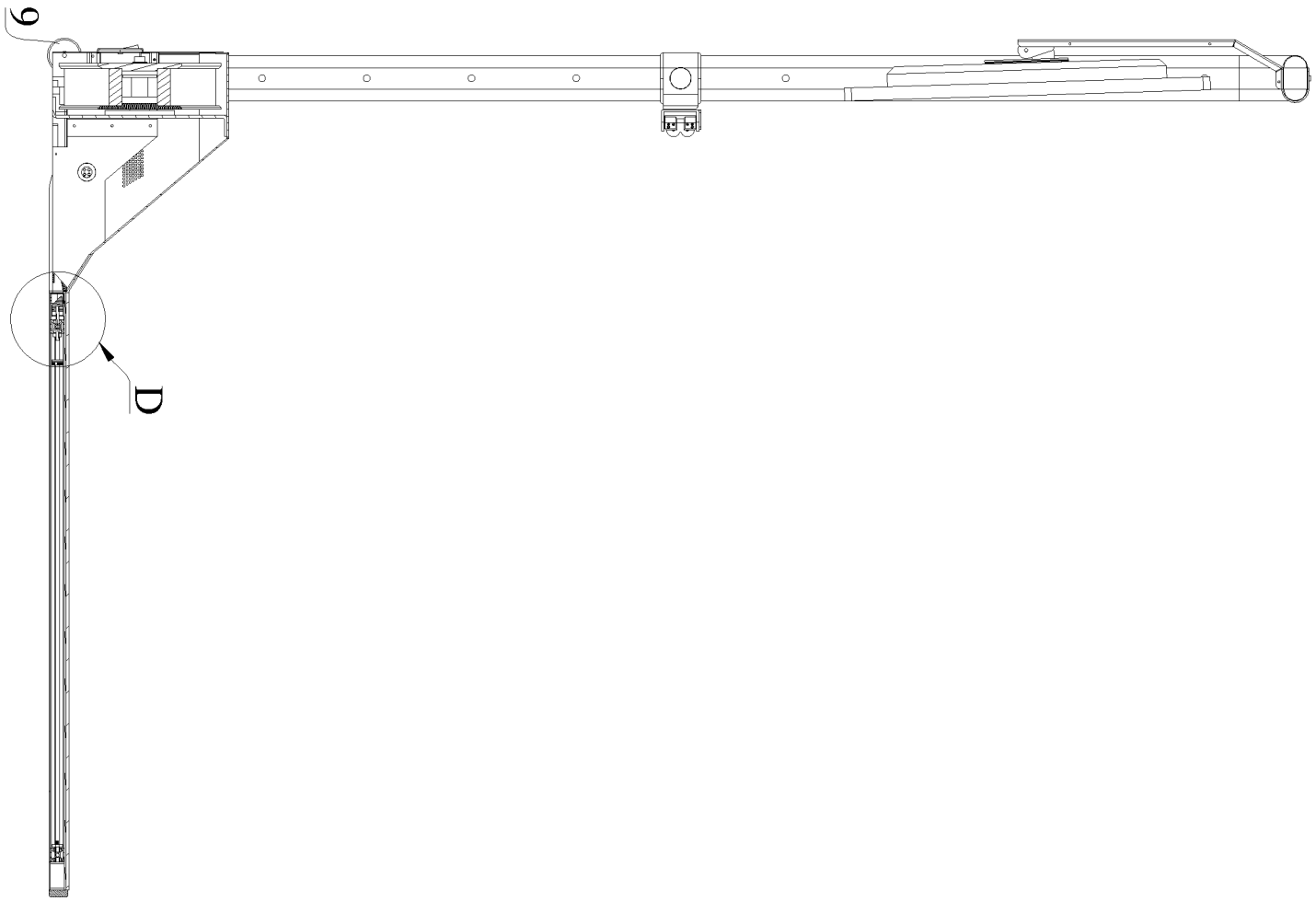
FIG. 10 is a sectional view of the multifunctional fitness facility of embodiment 1 of the present invention.

As shown in FIGS. 8 and 10, in order to facilitate the handling of the multifunctional fitness facility, the bottom of the motor compartment 2 is provided with a roller 9. Preferably, the roller 9 is located away from the pedal 1.

In summary, the multifunctional fitness facility provided by the present invention integrates the existing two commonly used strength training facilities, can be applicable to a variety of training actions, and has a very strong versatility; users do not need to purchase multiple training facilities, which reduces the cost of facility acquisition and saves the space required for facility placement, making it beneficial to enhance the user's experience and consumption experience. The pulley block and pulley mounting structure are easy to disassemble and assemble, and convenient to connect, which is conducive to enhancing the user experience; the vertical support assembly is equipped with a display screen, which can achieve training display and human-machine interaction; and there is a steering wheel set on the motor compartment, which can ensure the smooth stretching and retraction of the training rope.

The above descriptions are only embodiments of the present invention, and are not intended to limit the scope of the present invention. Any equivalent transformations made by using the contents of the description and drawings of the present invention, or directly or indirectly applied in related technical fields, are similarly included in the scope of the present invention.

What is claimed is:

1. A multifunctional fitness facility, comprising a pedal, a motor compartment, a pulley block, and a vertical support assembly fixedly connected to the motor compartment, wherein the pedal is connected to the motor compartment;

the motor compartment is provided therein with a motor, a training rope is wound on the motor, and an end of the training rope passes out of the pulley block;

the vertical support assembly is provided with a display screen, the vertical support assembly and the pedal are respectively provided with a pulley mounting structure, and the pulley block is detachably mounted in the pulley mounting structure of the vertical support assembly or the pedal;

the pulley block comprises a fixed frame, a locking mechanism cooperating with the pulley mounting structure of the vertical support assembly or the pedal is provided on the fixed frame, the locking mechanism comprises an elastic member, a clamping plate, a sliding locking block, and a rotary clamping pin, the clamping plate is connected to the fixed frame to form an accommodating groove for accommodating a partial area of the rotary clamping pin, the rotary clamping pin is rotatably arranged with respect to the fixed frame, one end of the rotary clamping pin is exposed out of the fixed frame, the sliding locking block is slidably arranged between the clamping plate and the rotary clamping pin, one end of the elastic member is connected to the sliding locking block, the other end of the elastic member is connected to the clamping plate or the fixed frame, the sliding locking block is provided with a locking head, the clamping plate is provided with a through hole for exposing the locking head, and the rotary clamping pin is provided with a protruding portion for driving the sliding locking block to slide; and the pulley mounting structure of the vertical support assembly or the pedal comprises a socket cooperating with the locking head and a limiting member limiting and fixing the clamping plate.

2. The multifunctional fitness facility of claim 1, wherein the pulley block further comprises a rotating frame and two universal wheels, two ends of the rotating frame are respectively rotatably connected to the fixed frame, the universal wheels are rotatably arranged on the rotating frame, and the end of the training rope passes out from between the two universal wheels.

3. The multifunctional fitness facility of claim 2, wherein the clamping plate is connected to one side of the fixed frame away from the universal wheels.

4. The multifunctional fitness facility of claim 3, wherein the rotary clamping pin comprises a rod portion and an operating portion, the operating portion is exposed on the fixed frame and connected to one end of the rod portion, and the protruding portion is provided on the rod portion.

5. The multifunctional fitness facility of claim 2, wherein at least one end of the rotating frame is a hollow structure, the at least one end of the rotating frame is provided with an entrance communicating with the hollow structure, the rotating frame is further provided with an exit communicating with the hollow structure, and a rope head of the training rope passes through the entrance, the hollow structure and the exit in sequence, and then the rope head of the training rope passes out from between the two universal wheels.

6. The multifunctional fitness facility of claim 1, wherein the pedal is rotatably connected to the motor compartment, and a locking apparatus is provided at a gap between the pedal and the motor compartment.

7. The multifunctional fitness facility of claim 6, wherein the locking apparatus comprises a lock body and a lock seat having a lock hole, the lock seat is provided on the motor compartment, the lock body comprises a lock tongue, a reset member and a guide rod, the guide rod is slidably provided on the pedal, the reset member is provided on the pedal for driving the lock tongue to be inserted into the lock hole, and the guide rod is connected to the lock tongue.

8. The multifunctional fitness facility of claim 7, wherein a guide surface is provided at a bottom of the lock tongue, a first locking bevel is provided at a top of the lock tongue, and a second locking bevel cooperating with the first locking bevel is provided in the locking hole.

9. The multifunctional fitness facility of claim 1, wherein the vertical support assembly comprises a vertical rod and a sliding sleeve which is liftable and provided on the vertical rod, and the sliding sleeve is provided with the pulley mounting structure of the vertical support assembly.

10. The multifunctional fitness facility of claim 9, wherein the sliding sleeve is provided with an elastic latch, the vertical rod is provided with a plurality of insertion holes arranged at intervals, and the insertion holes cooperate with the elastic latch.

* * * * *